US005642930A

United States Patent [19]

Brown, Sr.

[11] Patent Number: 5,642,930

[45] Date of Patent: Jul. 1, 1997

[54] THREE-DIMENSIONAL SCENERY THEME LAMP

[76] Inventor: Jackie C. Brown, Sr., 1544 SE. 174th Ave., Portland, Oreg. 97233

[21] Appl. No.: 530,941

[22] Filed: Sep. 20, 1995

[51] Int. Cl.[6] ..... F21P 1/02

[52] U.S. Cl. ..... 362/124; 362/414; 362/412; 362/806; 362/808; 40/433; 40/414

[58] Field of Search ..... 362/86, 412, 806, 362/808, 253, 234, 35, 249, 410, 124, 125, 431; 40/433, 414, 415, 429, 430, 431, 435

[56] References Cited

U.S. PATENT DOCUMENTS

| | | | |
|---|---|---|---|
| 2,097,061 | 10/1937 | Graf . | |
| 2,439,178 | 4/1948 | Marchand . | |
| 2,821,621 | 1/1958 | Allunario . | |
| 2,840,228 | 6/1958 | Takacs . | |
| 4,318,159 | 3/1982 | Kaisner . | |
| 4,652,980 | 3/1987 | Segan | 362/86 |
| 4,736,278 | 4/1988 | Wolens et al. . | |
| 4,923,721 | 5/1990 | Gilmore . | |
| 4,989,120 | 1/1991 | Davis et al. | 362/806 |
| 5,277,948 | 1/1994 | Daun | 362/806 |
| 5,345,153 | 9/1994 | Vaught | 362/806 |
| 5,439,407 | 8/1995 | Friedel | 40/431 |

*Primary Examiner*—Ira S. Lazarus
*Assistant Examiner*—Thomas M. Sember
*Attorney, Agent, or Firm*—Wells, St. John, Roberts, Gregory & Matkin, P.S.

[57] ABSTRACT

A three-dimensional scenery lamp includes a housing with a display chamber defined therein which is bounded on one side by an opening permitting user viewing of an interior region of the chamber from outside of the housing. A platform is mounted interiorly of the chamber and is capable of supporting a plurality of objects thereon for providing three-dimensional scenery within the interior region of the chamber. A light source is disposed interiorly of the chamber for selectively illuminating the platform, and a sound producer is mounted within the housing which is capable of producing music in association with the viewing of objects on the platform. Preferably, the platform is supported for rotation and at least one other scenery platform is provided, the platforms being interchangeable with one another for varying the scenery in the chamber.

14 Claims, 2 Drawing Sheets

THREE-DIMENSIONAL SCENERY THEME LAMP

BACKGROUND AND SUMMARY

This invention relates generally to illumination devices, and more particularly it concerns an illumination device which provides three-dimensional scenery.

Although a number of illumination devices, such as lamps and the like, are known to provide various types of scenery, the known devices are limited in utility for a number of important reasons discussed below.

Generally, lamps include, in the most basic form, a base, a stem connected to the base, a lightbulb-receiving socket attached to the stem, and a shade. Such lights, when turned on, illuminate the immediate surroundings. Yet, such lamps are rather mundane insofar as providing only for illumination of the immediate surroundings. That is to say, the utility of such lamps effectively ends at its light-giving capability. Accordingly, a need exists for a lamp, or more generally, an illumination device, which is more than just a light provider. A need exists for an illumination device which is entertaining, educational, interactive, fun-to-watch, and enjoyable to be around. Prior art attempts have been made to provide illumination devices which are more than just light providers, however, such attempts have failed to fully meet the needs of those individuals who desire more than just light from their illumination devices.

One such example is U.S. Pat. No. 4,318,159 to Kaisner which discloses a lamp fixture which includes a plurality of figurines mounted on the fixture's base. Two of the figurines are connected to electrical switches. One of the switches turns an external lightbulb on and off for conventional lamp operation. The other switch turns another lightbulb, mounted internally of one of the larger figurines, on and off to provide for an illuminated night-light. The figurines are bolted onto the fixture's base providing a generally static display which is not easily changeable without dismantling the lamp fixture.

A need exists for an illumination device, such as a lamp, with the capabilities of providing aesthetically-pleasing scenery which is changeable by a user for providing many varied scenes. Further, there is a need for a device which meets the shortfalls of the prior art by providing, in addition to variable scenery mentioned above, a music-producing device which allows a user to play varied musical selections for accommodating the changeable scenery.

With the above problems in mind, it is a general object of the present invention to provide an illumination device such as a lamp, which has changeable scenery for varying the so-called theme of the lamp.

It is another object of the invention to provide a variable theme lamp with a music producer so that the changing scenery may be accompanied with changing music for enhancing the theme of the lamp.

It is yet another object of the invention to provide a variable theme lamp with movable scenery for increasing the viewing pleasure of those viewing the lamp.

It is a further object of the invention to provide a lamp which is entertaining, especially for children, educational, interactive, fun-to-watch and enjoyable to be around.

The invention achieves these and other objects in the form of a three-dimensional scenery lamp which includes a housing with a display chamber defined therein which is bounded on one side by an opening permitting user viewing of an interior region of the chamber from outside of the housing.

A platform is mounted interiorly of the chamber and is capable of supporting a plurality of objects thereon for providing three-dimensional scenery within the interior region of the chamber. A light source is disposed interiorly of the chamber for selectively illuminating the platform and a sound producer is mounted within the housing which is capable of producing music in association with the viewing of objects on the platform.

According to one feature of the invention, at least one other scenery-supporting platform is provided and the platforms are interchangeable with one another for providing a variety of scenery. Additionally, a rotational mechanism in the form of a conventional turntable is provided internally of the chamber and supports a selected scenery platform for rotation about a defined center.

According to another feature of the invention, an additional light source is provided which is mounted exteriorly of the chamber for conventional lamp operation.

These and additional objects and advantages of the present invention will be more readily understood after a consideration of the drawings and the detailed description of the preferred embodiment.

DETAILED DESCRIPTION OF THE PREFERRED EMBODIMENTS

The First Preferred Embodiment

Figure 1:
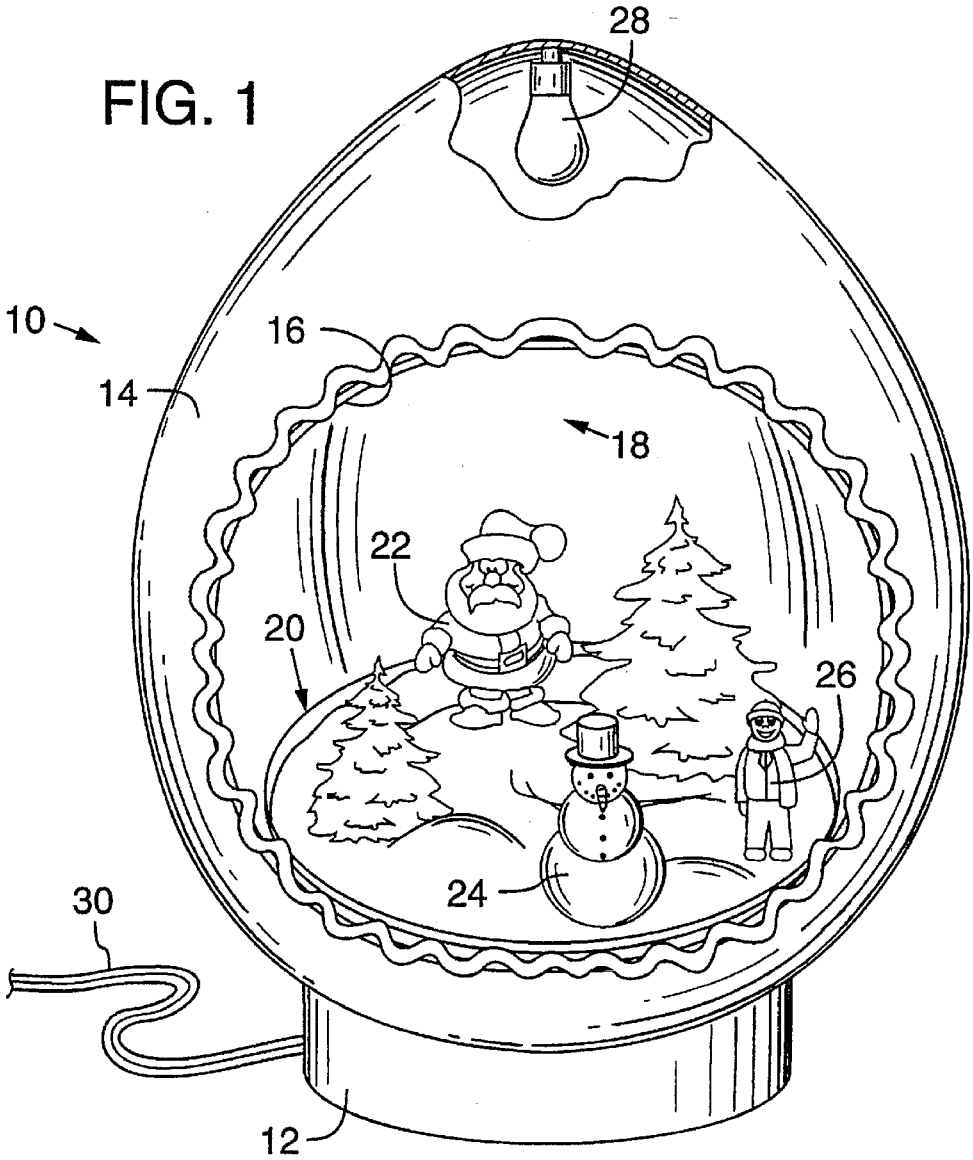
FIG. 1 shows a front elevation of an illumination device according to a first preferred embodiment.

Referring now to the drawings, and specifically to FIG. 1, the reader will see an illumination device according to a first preferred embodiment generally at 10.

Device 10 may be seen to include a base 12 joined to and supporting a generally egg-shaped housing 14 bounded on one side by a generally circular opening 16 and having defined therein a hollow chamber 18 for displaying various scenery described in more detail below. Chamber 18 includes an interior region which is viewable from externally thereof. Base 12 and housing 14 are preferably formed from injection-molded plastic, although any suitable material such as paper maché, ceramic, or wood may be used. Although the first preferred embodiment is generally egg-shaped, it will be understood that any suitably-shaped enclosure will suffice. These shapes may include spherical, rectangular, square, and triangular shapes to name just a few.

A scenery-supporting platform, shown generally at 20 in FIG. 1, is mounted interiorly of chamber 18 and within the interior region mentioned above. A plurality of objects, such as those shown at 22, 24, and 26 described in more detail below, may be seen on platform 20 and are preferably fixed, as by gluing, tacking, or any other suitable mounting means. It is also possible for objects 22–26 to be removably mounted on platform 20 to enable an individual to rearrange, at will, the scenery located thereon. The objects and scenery are viewable, by virtue of opening 16, from a position externally of the enclosure. Platform 20 is supported for movement within chamber 18 by so-called movement structure which is shown in FIG. 2 at 32, and described in detail just below.

A portion of housing 14 has been broken away in FIG. 1 to expose a light source 28 in the form of a conventional lightbulb which is disposed or mounted interiorly of chamber 18, and positioned, preferably adjacent the top of chamber 18 and above platform 20 as shown, for operation by a switch which is not specifically shown, but will be understood to be operatively connected to a cord 30 which is only partially shown and which may be plugged into a conventional wall socket for providing power to the light source for the selective illumination of platform 20 in the chamber's interior. The interior of chamber 18 may include a reflective lining so that when light source 28 is illuminated, the light provided thereby is effectively distributed over the entire scenery chamber.

Figure 2:
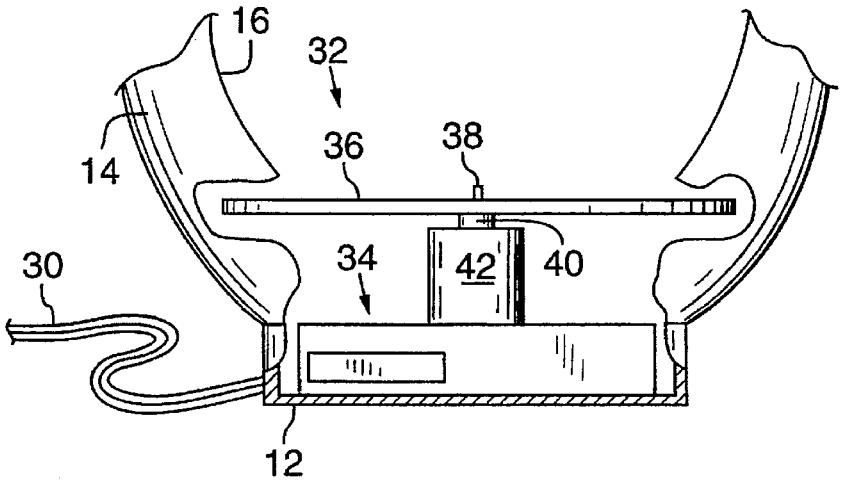
FIG. 2 shows an enlarged portion of the device of FIG. 1, with a portion broken away to show internal structure.

Turning attention to FIG. 2, a fragmentary bottom portion of device 10 is shown, and the reader will see that a portion of base 12 has been removed, as well as a portion of housing 14, to expose some internal componentry in more detail. Shown generally at 32, 34, respectively, are movement structure (mentioned above) and a sound producer. Each is described separately in more detail below.

Movement structure 32 may be seen mounted interiorly of chamber 18 in the form of a turntable 36 which defines a generally circular, flat surface upon which various scenery platforms may be supported for movement, which in the preferred embodiment is rotational movement about a defined center indicated by a centrally disposed tab 38.

The mechanism which effects the preferred rotational movement, in addition to including turntable 36, includes a standard driven shaft 40, which may be driven by any suitable motor 42 mounted in base 12. In the preferred embodiment, motor 42 is a conventional AC-powered motor such as one would find in a record player. It will be appreciated that other motors, such as battery-powered DC motors would work as well. Further, motor 42 may be a one- or a variable-speed motor.

Sound producer 34 is preferably a music player and is mounted within housing 14, preferably in base 12, and is accessible from exteriorly of chamber 18, and is capable of producing music in association with user-viewing of objects on scenery platform 20. Sound producer 34 may be any suitable music player such as a compact disc player, a tape player, a radio, or any other sound producer which is capable of producing music or other sounds. Sound producer 34 may be accessed from externally of chamber 18 through opening 16, or an access door (not specifically shown) may be provided in base 12 for allowing a user to access the producer for changing a CD, tape, or radio station.

It will be appreciated that sound producer 34 provides the capability of varying the musical selection which may be listened to in conjunction with viewing scenery on platform 20.

Figure 3:
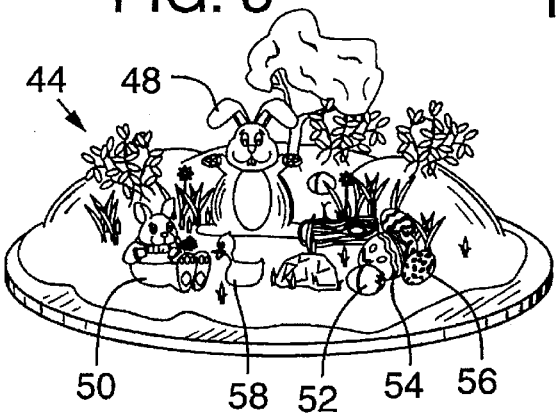
FIGS. 3 and 4 show two scenery platforms dimensioned for use by the present invention.

With respect to the scenery platforms mentioned above, the reader's attention is directed to FIGS. 3 and 4, where two of such platforms may be seen, generally, at 44 (FIG. 3) and 46 (FIG. 4), respectively.

Platform 44 may be seen to include plural objects, such as an Easter Bunny 48, another little bunny 50, Easter eggs 52, 54, 56, and a duck 58 to name just a few of the objects. Needless to say, platform 44 carries a distinctly Easter theme, which, when mounted on turntable 36 for rotation in the interior region of chamber 18, provides a pleasing holiday scene which may be enjoyed by young and old alike. It will be understood that each of the scenery platforms is provided with a centrally-disposed aperture which is not specifically shown, but will be understood to mate with tab 38 (FIG. 2) so that the platform may be mounted on the turntable in much the same way a record is placed on a record player. It will be appreciated, however, that any suitable manner of removably mounting the platform will suffice, and that such other manners are within the spirit and scope of the invention. In addition, sound producer 34 and the rotatability of turntable 36 combine to make for an even more pleasing holiday scene which may be accompanied by Easter music.

Figure 4:
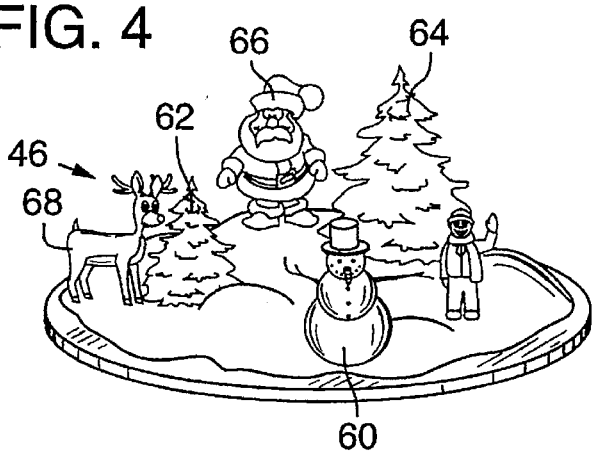

FIG. 4 shows another platform 46 which will be understood to be interchangeable with platform 44 or any other platform which may be provided. Platform 46 includes plural objects, such as snowman 60, evergreens 62, 64, a Santa Claus 66, and deer 68 which creates a pleasing Christmas holiday scene. Again, sound producer 34 and the rotatability of turntable 36 provide for a complete and pleasing holiday scene. It should be apparent that the themes of the scenery platforms may be varied, and the platforms may be exchanged with one another for providing a unique and changing scene in the interior region of chamber 18. Additionally, it is not necessary for only holiday scenes to be depicted, rather any number of different types of scenes may be depicted. These may include seasonal scenes such as winter, summer, spring, and fall scenes, cartoon character scenes, religious scenes and the like.

The Second Preferred Embodiment

Figure 5:
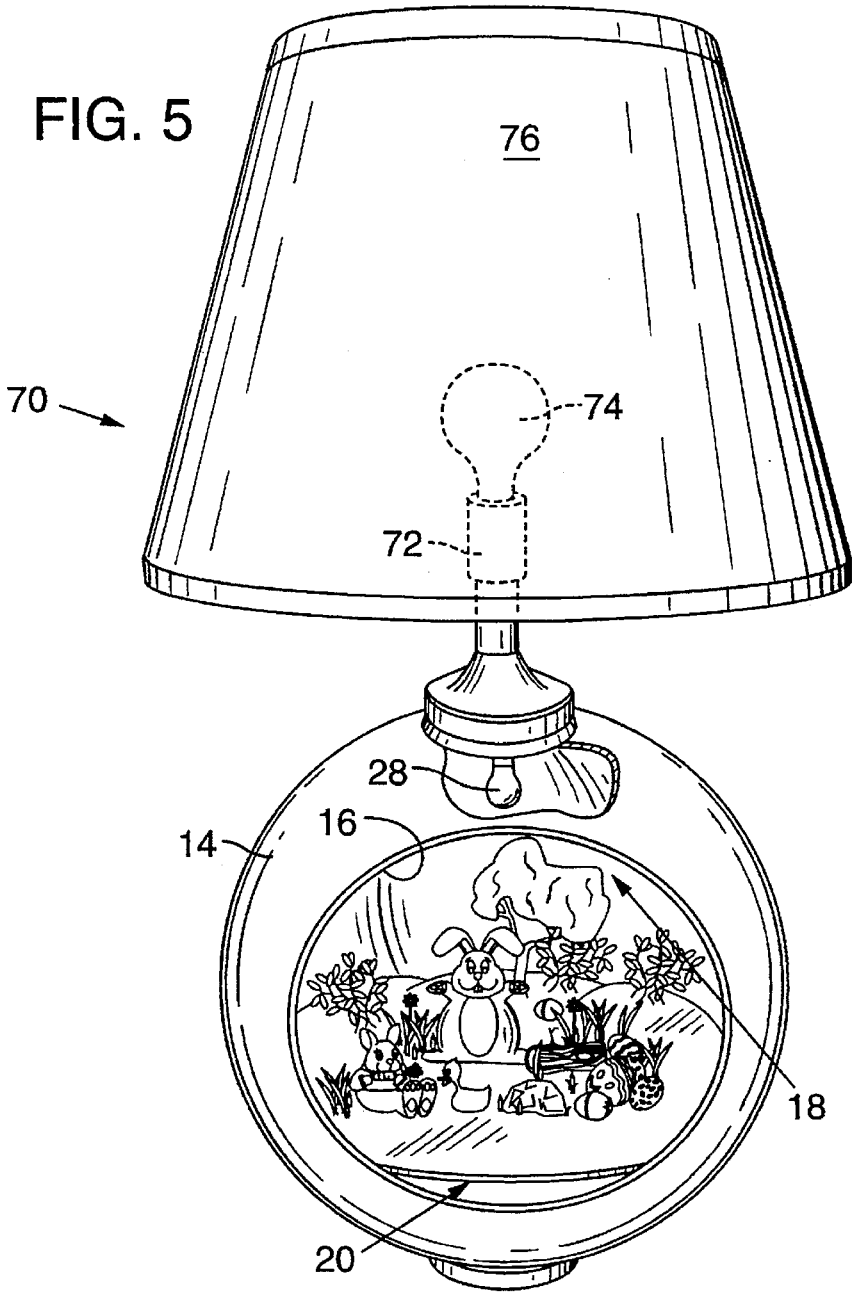
FIG. 5 shows a front elevation of an illumination device according to a second preferred embodiment.

FIG. 5 shows an illumination device according to a second preferred embodiment generally at 70. In addition to including all of the features described above, similar features being similarly designated, chamber 18 (which may be seen to be generally spherical), has mounted thereabove, a lightbulb-receiving socket 72 for receiving a lightbulb 74 and illuminating an area externally of chamber 18. A shade 76 is conventionally mounted on device 70. In addition, a light source 28 is mounted internally of chamber 18 which functions in the same way as described with reference to the first preferred embodiment. It will be understood that the light sources in the second embodiment may, and preferably do, operate on a three-way switch, which at one setting illuminates bulb 74 externally of the chamber, at another setting illuminates only source 28 internally of the chamber, and in yet at a third setting illuminates both bulbs, internally and externally of chamber 18.

Housing 14 in both embodiments is around one- to two-feet tall, although any suitable size would suffice.

Operation

In operation, devices 10 and 70 provide three-dimensional, variable-scenery, musical illumination devices which are entertaining, educational, and interactive. Entertainment may be derived by individuals who are young and old alike, by being able to observe a pleasing scene, such as the holiday scenes discussed above, which is rotated for complete viewing, while listening to theme-oriented music which is playable on sound producer 34. Thus, for example, a Christmas scene such as the one shown in FIG. 4 may be placed on platform 20, rotated about its center by turntable 36, and various Christmas music played over sound producer 34 to foster a Christmas environment and provide a dynamically-changing holiday experience. It should be apparent that one advantage of the present invention is that, unlike other Christmas decorations and theme-specific devices, it need not be packed away to await another Christmas season which is a whole year away. Rather, the scenery platform may be changed to reflect the next-coming holiday or any other desirable scene.

The present devices are interactive insofar as each gives the user the capability of changing the scene, music, or both, and hence the theme of the device which allows the devices to be effectively adapted for seasonal changes, or holiday or religious occasions to name just a few.

The present devices provide scenes and themes which are fun-to-watch and enjoyable to be around because the character of the device is easily changed or adapted to suit any number of present needs, be they holiday, seasonal, religious, etc.

After the above description, it should be apparent that devices 10, 70 are capable of enjoyment by young and old alike. It will be appreciated however, that the above devices may be particularly adapted for use by children, for providing an entertaining and educational illumination device. For example, various scenery platforms may be provided which have themes specifically suited for young children. These themes may include favorite cartoon themes such as Bugs Bunny, the Road Runner, and Yosemite Sam, or television themes such as the Power Rangers, and Barney (the purple dinosaur), or various children's movie themes such as Aladdin, Beauty and the Beast, or Pocahontas. Needless to say, the variations on themes are innumerable. In addition to providing variable scenery themes, devices 10, 70 give the user the capability of changing the music which accompanies the scenery, and the rotatable turntable provides the user with a unique and dynamic perspective of the scenery thereon. It is not difficult to imagine the wonderment and hours of enjoyment a young child may derive by being able to view a scene from a favorite movie or television show, while listening to the movie or television sound track.

Accordingly, a child might place such a lamp on a desk or dresser for providing, in part, a conventional lamp as described in the second preferred embodiment. Smaller versions of the lamp would be suitable for use as night lights, especially lamps constructed according to the first preferred embodiment in which the light source is internally mounted and does not meaningfully illuminate the exterior of the chamber.

Thus, numerous modifications are contemplated, and are believed to be within the spirit and scope of the invention.

Briefly summarizing, a three-dimensional scenery lamp has been described which includes a housing with a display chamber defined therein which is bounded on one side by an opening permitting user viewing of an interior region of the chamber from outside of the housing. A platform is mounted interiorly of the chamber and is capable of supporting a plurality of objects thereon for providing three-dimensional scenery within the interior region of the chamber. In the preferred embodiments, the platform is supported for rotation by a conventional turntable which provides a panoramic perspective of the scenery carried thereon, and at least one other platform is provided and is interchangeable with the other platform for varying the scenery internally of the chamber. Additionally, a light source is disposed interiorly of the chamber for selectively illuminating the platform and a sound producer is mounted within the housing which is capable of producing music in association with the viewing of objects on the platform. According to another preferred embodiment, another light source is mounted exteriorly of the chamber and provides, in part, a conventional lamp.

While the present invention has been shown and described with reference to the foregoing preferred embodiments, it is to be understood by those skilled in the art that other changes in form and detail may be made thereon without departing from the spirit and scope of the invention as defined in the appended claims.

It is claimed and desired to secure by letters patent:

1. A three-dimensional interactive lamp comprising:

a one-piece, integrally formed, housing including a display chamber defined within the one-piece housing, the chamber being bounded on one side by an opening permitting user viewing of an interior region of the chamber from outside the housing, the opening also permitting user access to the interior region;

a platform rotatably and removably mounted interiorly of the chamber in the interior region, the platform being capable of supporting a plurality of objects thereon for rotating the objects and for providing three-dimensional scenery within the interior region of the chamber, the platform further being removable from the one-piece housing through the opening therein; and a light source mounted to an interior wall of the chamber for selectively illuminating the platform.

2. The device of claim 1 further comprising a turntable upon which the platform is mounted for rotating the same, and at least one other platform, the platforms being interchangeable with one another for varying the scenery in the interior region of the chamber.

3. The device of claim 1 further comprising another light source mounted externally of the display chamber which is capable illuminating an area exteriorly thereof.

4. The device of claim 1, wherein the sound producer includes a tape player.

5. The device of claim 1, wherein the sound producer includes a compact disc player.

6. The lamp of claim 1 further comprising a sound producer mounted within the housing which is capable of producing music in association with user viewing of objects on the platform.

7. A variable-scenery lamp comprising:

a base placeable on a flat surface a scenery chamber connected to the base having an opening for permitting user viewing of the chamber and for permitting access from outside thereto;

a removable platform supported for rotation within the chamber for supporting a plurality of objects which are viewable through the opening, the platform being removable through said opening;

at least one other platform interchangeable with said removable platform, said at least one other platform being insertable through the opening in the scenery chamber; and a music player mounted within the lamp which is accessible from exteriorly of the chamber, for enabling a user to play a variety of music.

8. The lamp of claim 7 further comprising a motor operatively coupled to a turntable for rotating the platform about a defined center.

9. The lamp of claim 7 further comprising at least one other platform for supporting a plurality of objects, the platforms being exchangeable with one another for varying the scenery within the chamber.

10. The lamp of claim 7 further comprising a light source mounted generally interiorly of the chamber for selectively illuminating the chamber's interior and the platform-supported scenery.

11. The lamp of claim 10 further comprising another light source which is mounted generally exteriorly of the chamber for selectively illuminating an area exteriorly of the chamber.

12. A musical, three-dimensional, rotational, variable-scenery lamp comprising:

a base;

a chamber connected to the base, the chamber having an interior region and an opening for providing access to the interior region;

a plurality of platforms one of which being mounted within the chamber in the interior region for supporting a plurality of objects thereon, at least one other platform supporting objects which are different from said plurality of objects, said at least one other platform being interchangeable with the platform mounted within the chamber for varying the scenery therewithin;

a rotation mechanism mounted in the base and operatively coupled to the platform for rotating the same and the objects supported thereon about a defined center;

a light mounted within the chamber and positioned for illuminating the platform; and a music player mounted within the lamp adjacent the chamber and accessible from externally thereof for enabling the selective production of music, said music player enabling music produced thereby to be changed by a user.

13. The device of claim 12 further comprising another light mounted exteriorly of the chamber for illuminating an area exteriorly thereof.

14. The device of claim 12, wherein the rotation mechanism includes a motor-driven turntable.

* * * * *